US006832678B2

(12) United States Patent
Ogura et al.

(10) Patent No.: US 6,832,678 B2
(45) Date of Patent: Dec. 21, 2004

(54) ESCALATOR WITH HIGH SPEED INCLINED SECTION

(75) Inventors: Manabu Ogura, Tokyo (JP); Takashi Yumura, Tokyo (JP); Joichi Nakamura, Fukuoka (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 9 days.

(21) Appl. No.: 10/433,626

(22) PCT Filed: Sep. 19, 2002

(86) PCT No.: PCT/JP02/09623

§ 371 (c)(1),
(2), (4) Date: Jun. 5, 2003

(87) PCT Pub. No.: WO03/029125

PCT Pub. Date: Sep. 10, 2002

(65) Prior Publication Data

US 2004/0035676 A1 Feb. 26, 2004

(30) Foreign Application Priority Data

Sep. 26, 2001 (JP) ..... 2001-294603

(51) Int. Cl.[7] ..... B66B 23/14; B66B 21/02

(52) U.S. Cl. ..... 198/322; 198/329; 198/330; 198/333; 198/334

(58) Field of Search ..... 198/322, 326, 198/329, 330, 333, 334, 812, 814

(56) References Cited

U.S. PATENT DOCUMENTS

| | | | | |
|---|---|---|---|---|
| 3,834,520 A | * | 9/1974 | Patin | 198/334 |
| 4,130,192 A | | 12/1978 | Kraft | |
| 4,240,537 A | * | 12/1980 | Dunstan | 198/334 |
| 4,284,191 A | * | 8/1981 | Lavau | 198/792 |
| 4,462,514 A | * | 7/1984 | Dunstan | 198/334 |
| 4,671,783 A | * | 6/1987 | Seymour | 474/148 |
| 5,115,899 A | | 5/1992 | Nakatani | |
| 5,538,384 A | * | 7/1996 | Haldimann | 414/286 |
| 5,829,570 A | | 11/1998 | Kwon | |
| 5,899,314 A | | 5/1999 | Kwon | |
| 6,390,270 B1 | * | 5/2002 | Utsunomiya et al. | 198/326 |
| 6,450,317 B1 | * | 9/2002 | Fargo et al. | 198/330 |
| 6,588,573 B1 | * | 7/2003 | Ogura et al. | 198/334 |
| 6,591,959 B1 | * | 7/2003 | Ogura et al. | 198/334 |
| 6,637,579 B2 | * | 10/2003 | Pietz | 198/322 |
| 6,685,004 B2 | * | 2/2004 | Fargo et al. | 198/330 |

FOREIGN PATENT DOCUMENTS

| | | |
|---|---|---|
| JP | 51-116586 | 10/1976 |
| JP | 8-108986 | 4/1996 |
| JP | 2001-31355 | 2/2001 |
| JP | 2002-326780 | 11/2002 |

* cited by examiner

*Primary Examiner*—Douglas Hess
(74) *Attorney, Agent, or Firm*—Leydig, Voit & Mayer, Ltd.

(57) ABSTRACT

In an escalator with a high speed inclined section, steps are coupled in an endless manner and circulate. Driving roller shafts of the steps adjacent to each other are coupled with each other by a link mechanism. An interval between the driving roller shafts is changed as the link mechanism is transformed. An outer peripheral length change absorbing mechanism is provided in a reversing section of a circulation path of the steps. The outer peripheral length change absorbing mechanism absorbs a change in an outer peripheral length of a polygon, formed by connecting axes of the driving rollers with straight lines, while guiding movement of the driving rollers in the reversing section.

7 Claims, 9 Drawing Sheets

ESCALATOR WITH HIGH SPEED INCLINED SECTION

TECHNICAL FIELD

This invention relates to an escalator with a high speed inclined section in which steps move faster in an inclined section than in upper and lower horizontal sections.

BACKGROUND ART

Nowadays, a large number of escalators of great height are installed in subway stations or the like. In an escalator of this type, the passenger is obliged to stand on a step for a long period of time, which is often rather uncomfortable. In view of this, a high-speed escalator has been developed. However, in such a high-speed escalator, there is a limitation regarding the traveling speed from the viewpoint of allowing the passengers to get off and on safely.

In view of this, there has been proposed an escalator with a high speed inclined section in which the steps move faster in the intermediate inclined section than in the upper and lower horizontal sections, whereby it is possible to shorten the traveling time for the passenger.

FIG. 6 is a schematic side view showing a conventional escalator with a high speed inclined section described, for example, in JP 51-116586 A. In the figure, a plurality of steps 2 coupled in an endless manner are provided in a main frame 1. The steps 2 are driven by a drive unit (step driving means) 3 and moved to circulate.

A circulation path of the steps 2 has a forward path side section, a return path side section, an upper side reversing section L, and a lower side reversing section M. The steps 2 perform a reversing movement from a forward path side to a return path side or from the return path side to the forward path side in the upper side reversing section L and the lower side reversing section M.

The forward path side section of the circulation path of the steps 2 has a forward path upper side horizontal section A to be an upper side platform portion, a forward path side upper curved section B, a forward path side constant inclination section C, a forward path side lower curved section D, and a forward path lower side horizontal section E to be a lower side platform portion. The return path side section of the circulation path of the steps 2 has a return path upper side horizontal section F, a return path side upper curved section G, a return path side constant inclination section H, a return path side lower curved section J, and a return path lower side horizontal section K.

Next, FIG. 7 is a side view showing the vicinity of the forward path side upper curved section B of FIG. 6 in an enlarged state. A speed variation principle of a variable-speed escalator will be described using this figure. In the figure, the step 2 has a footplate 4 for carrying a passenger; a riser 5 formed to be bent at one end in a longitudinal direction of the footplate 4; and a pair of brackets 6 provided integrally with the footplate 4 and the riser 5 at both ends in a width direction thereof. The riser 5 serves as a riser plate which blocks an opening portion between the footplates 4 adjacent to each other.

A driving roller shaft 7*a* and a trailing roller shaft 9*a* are provided to the bracket 6 of each step 2. A pair of rotatable driving rollers 7 are attached to the driving roller shaft 7*a*. The driving rollers 7 are guided by forward path side drive rails 8*a* supported by the main frame 1 (FIG. 6).

A pair of rotatable trailing rollers 9 are attached to the trailing roller shaft 9*a*. The trailing rollers 9 are guided by forward path side trail rails 10*a* supported by the main frame 1. Note that shapes of the forward path side driving rails 8*a* and the forward path side trail rails 10*a* are formed such that the footplate 4 of the step 2 always keeps a level in forward path side sections.

The driving roller shafts 7*a* of the adjacent steps 2*a* recoupled with each other by a link mechanism (bending link mechanism) 11. Auxiliary rollers 12 are provided in the vicinity of a curving point P of the link mechanism 11. The auxiliary rollers 12 are guided by auxiliary rails 13 supported by the main frame 1. The auxiliary rollers 12 are guided by the auxiliary rails 13, whereby the link mechanism 11 transforms so as to bend and stretch, and an interval between the driving roller shafts 7*a*, that is, a gap between the adjacent steps 2 is changed. Conversely, a track of the auxiliary rails 13 is designed such that the gap between the adjacent steps 2 changes.

In addition, although FIG. 7 shows the structure in which the gap between the steps 2 is changed in the forward path side upper curved section B, the gap between the steps 2 is arranged to be changed also in the forward path side lower curved section D with the same structure.

That is, in the forward path side sections, the gap between the adjacent steps 2 is continuously changed in accordance with advance of the steps 2 so as to be the smallest in the upper side horizontal section A and the lower side horizontal section E serving as platform portions, to be the largest in the constant inclination section C, and to change from the largest to the smallest or from the smallest to the largest in the upper curved section B and the lower curved section D.

Next, movements will be described. When the steps 2 of the endless manner are driven by starting-up of the drive unit 3, the driving rollers 7 of each step 2 and the trailing rollers 9 are moved to rotate on the drive rails 8*a* and the trail rails 10*a*, respectively. Simultaneously with this, the auxiliary rollers 12 are moved to rotate along the auxiliary rails 13, the link mechanism 11 is transformed according to a shape of the auxiliary rails 13, and the gap between the steps 2 is enlarged or reduced.

Due to the transformation of the link mechanism 11, in the forward path upper side horizontal section A and the forward path lower side horizontal section E, the gap between the steps 2 becomes the smallest, and the adjacent footplates 4 come into a state in which they continue in an identical horizontal plane shape. In the forward path side constant inclination section C, the gap between the steps 2 becomes the largest, and the adjacent footplates 4 displace in a step shape.

In one of the forward path side upper curved section B and the forward path side lower curved section D, the gap between the steps 2 changes from the largest to the smallest, and the adjacent footplates 4 displace from the step shape to the identical horizontal plane shape. In the other of the forward path side upper curved section B and the forward path side lower curved section D, conversely, the gap between the steps 2 changes from the smallest to the largest, and the adjacent footplates 4 displace from the identical horizontal plane shape to the step shape.

In this way, since the gap between the steps 2 changes according to the actuation of the link mechanism 11 following the advance of the steps 2, the steps 2 coupled in the endless manner are moved at a variable speed.

Since the plurality of steps 2 are driven to circulate in the endless manner by the drive unit 3 in the above description, a reversing section is required as a transition section between a forward path section and a return path section. In order to make the reverse of the steps 2 possible, it is necessary to keep a posture of the steps 2 in the reversing section, and for this purpose, it is necessary to regulate a moving route in the reversing section of the driving roller 7 and the trailing roller 9.

Thus, in the conventional escalator with a high speed inclined section as described above, a structure of a reversing section as shown in FIG. 8 (the figure shows an upper side reversing section L) is adopted. That is, forward path side reversing section drive rails 8*b* of an arc shape, which are fixed in a form extending to the reversing section side from the forward path side drive rails 8*a*, and return path side reversing section drive rails 8*c* of an arc shape, which are fixed in a form extending to the reversing section side from the return path side drive rails 8*d*, are used.

In addition, as to the trail rails, a forward path side reversing section trail rails 10*b* of an arc shape and a return path side reversing section trail rails 10*c* of an arc shape, which are fixed in a form extending to the reversing section side from the forward path side trail rails 10*a* and the return path side trail rails 10*d*, respectively, are used.

In FIG. 8, in the case in which the steps 2 advance, for example, in a Y direction, the driving rollers 7 move to rotate on the rails in the order of the forward path side drive rails 8*a*, the forward path side reversing section drive rails 8*b*, the return path side reversing section drive rails 8*c*, and the return path side drive rails 8*d*. The trailing rollers 9 move to rotate on the rails in the order of the forward path side trail rails 10*a*, the forward path side reversing section trail rails 10*b*, the return path side reversing section trail rails 10*c*, and the return path side trail rails 10*d*. Accordingly, the steps 2 become capable of passing the reversing section in a stable posture.

At this point, the movement of the driving rollers 7 in the reversing section is the same as the movement of a vertex of a polygon when the polygon with an axis of the driving rollers 7 as its vertex rotates. FIG. 9 is an explanatory view showing the movement of the driving rollers 7 in the reversing section of FIG. 8. In FIG. 9, the movement of the driving rollers 7 in the upper side reversing section L is schematically shown.

It is assumed that the driving rollers 7 exist in a position of a white circle in the figure in its initial state. It is assumed that the steps 2 are driven by the drive unit, whereby the driving rollers 7 on the forward path side are moved in a Z1 direction in the figure from the position, and the driving rollers 7 on the return path side are moved in a Z2 direction in the figure to be displaced to a position indicated by a black circle.

At this point, when lengths of an outer periphery of the polygon on the reversing section side of a reference line MN (left side in the figure), that is, a length of a broken line and a length of a solid line are compared between the initial state and the state after the displacement, a slight difference occurs between both the lengths. In this way, in the reversing section, the steps 2 move as the outer peripheral length of the polygon formed by connecting the axes of the driving rollers 7 with straight lines changes little by little on a constant basis.

In the conventional escalator with a high speed inclined section constituted as described above, since the forward path side reversing section drive rails 8*b* and the return path side reversing section drive rails 8*c*, for guiding the movement of the driving rollers 7 in the reversing section, are fixed to the main frame 1, the change in the outer peripheral length of the polygon formed by connecting the axes of the driving rollers 7 with straight lines cannot be absorbed, and increase in a drive resistance force of the steps 2 due to increase in a pressing force of the driving rollers 7 to the rails 8*b* and 8*c* is caused with the result that a smooth reversing movement cannot be obtained.

DISCLOSURE OF THE INVENTION

The present invention has been made in order to solve the problem described above, and it is therefore an object of the present invention to obtain an escalator with a high speed inclined section that can realize a smooth reversing movement of steps by suppressing increase in a drive resistance force.

To this end, according to one aspect of the present invention, there is provided an escalator with a high speed inclined section comprising: a main frame; a plurality of steps provided in the main frame and are coupled in an endless manner to be moved so as to circulate; a driving roller shaft and a trailing roller shaft which are provided to each of the steps; driving rollers provided to each of the steps and are rotatable about the driving roller shaft; trailing rollers provided to each of the steps and are rotatable about the trailing roller shaft; a plurality of link mechanisms which couple the driving roller shafts of the steps adjacent to each other, for changing an interval between the driving roller shafts by being transformed; rotatable auxiliary rollers provided to each of the link mechanisms; drive rails provided to the main frame for guiding a movement of the driving rollers; trail rails provided to the main frame for guiding a movement of the trailing rollers; auxiliary rails provided to the main frame for guiding a movement of the auxiliary rollers to transform the link mechanisms; and an outer peripheral length change absorbing mechanism provided in a reversing section of a circulation path of the steps for absorbing a change in an outer peripheral length of a polygon formed by connecting axes of the driving rollers with straight lines while guiding the movement of the driving rollers in the reversing section.

BEST MODE FOR CARRYING OUT THE INVENTION

Preferred embodiments of the present invention will be hereinafter described with reference to the drawings.

First Embodiment

Figure 1:
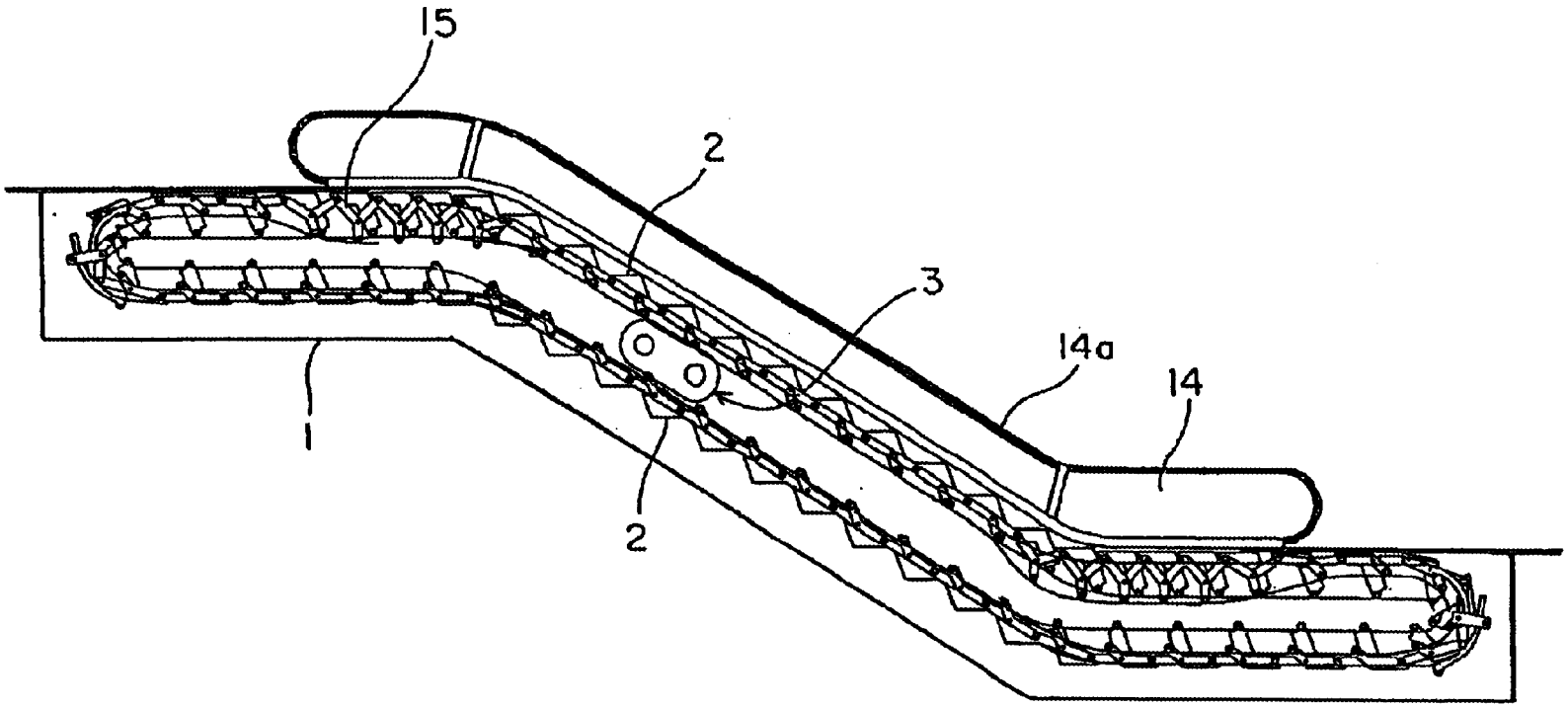
FIG. 1 is a schematic side view showing an escalator with a high speed inclined section according to a first embodiment of the present invention.

FIG. 1 is a schematic side view showing an escalator with a high speed inclined section according to a first embodiment of the present invention. In the figure, a plurality of steps 2 coupled in an endless manner are provided in a main frame 1. The steps 2 are driven by a drive unit (step driving means) 3 and moved to circulate. A pair of railings 14 are vertically provided on the main frame 1 on both sides of the steps 2. Moving handrails 14*a* for prevention of stumble of passengers is provided on the railings 14. The steps 2 adjacent to each other are coupled by a link mechanism 15.

Figure 2:
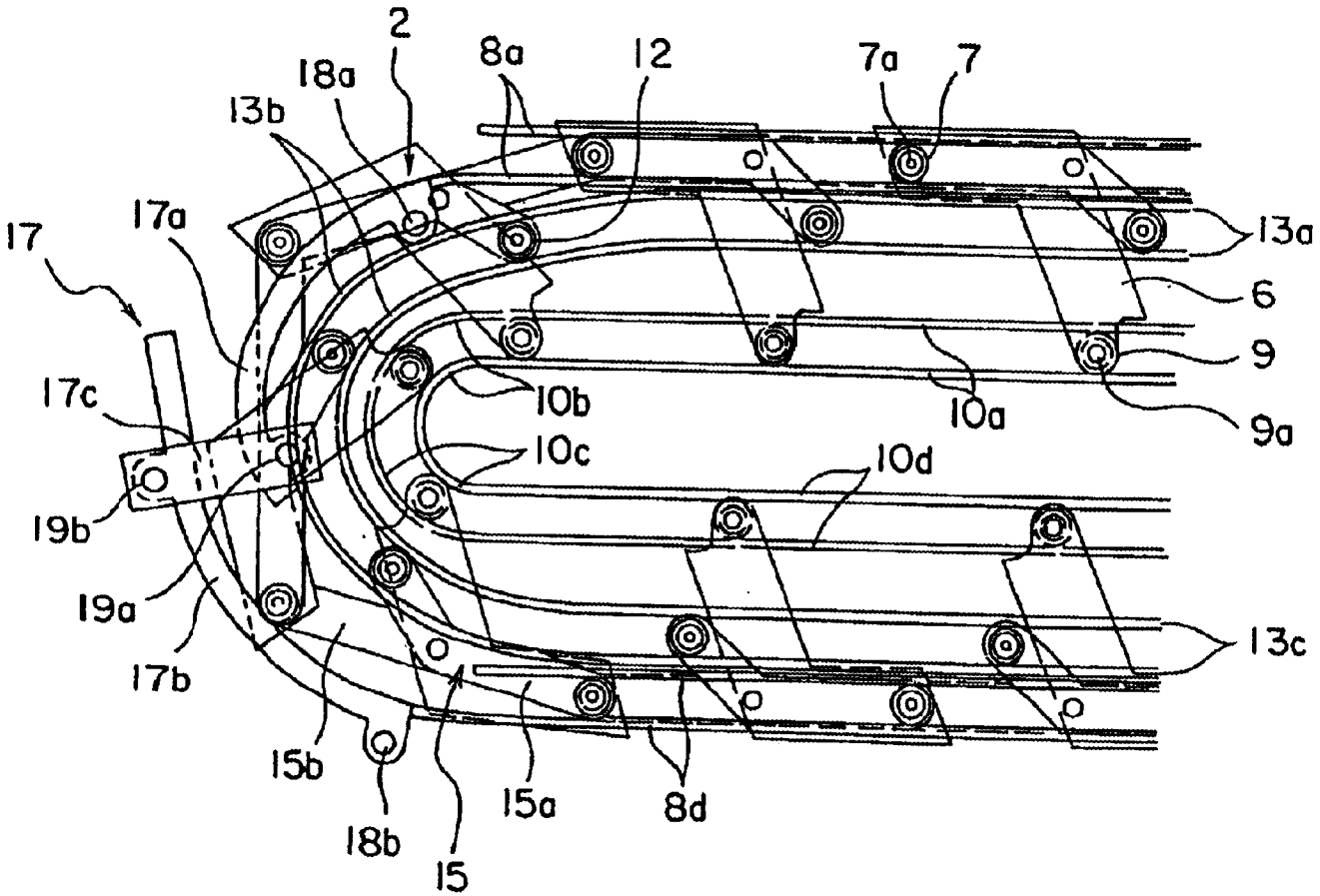
FIG. 2 is a side view showing the upper side reversing section of FIG. 1 in an enlarged state.

Next, FIG. 2 is a side view showing the upper side reversing section of FIG. 1 in an enlarged state. A driving roller shaft 7*a* and a trailing roller shaft 9*a* are provided to a bracket 6 of each step 2. A pair of rotatable driving rollers 7 are attached to the driving roller shaft 7*a*. The driving rollers 7 are guided by forward path side drive rails 8*a* and return path side drive rails 8*d* which are supported by the main frame 1.

A pair of rotatable trailing rollers 9 are attached to the trailing roller shaft 9*a*. The trailing rollers 9 are guided by forward path side trail rails 10*a*, forward path side reversing section trail rails 10*b*, return path side reversing section trail rails 10*c*, and return path side trail rails 10*d* which are supported by the main frame 1. Note that shapes of the forward path side drive rails 8*a* and the forward path side trail rails 10*a* are formed such that a footplate 4 (FIG. 7) of the step 2 always keeps a level.

Figure 7:
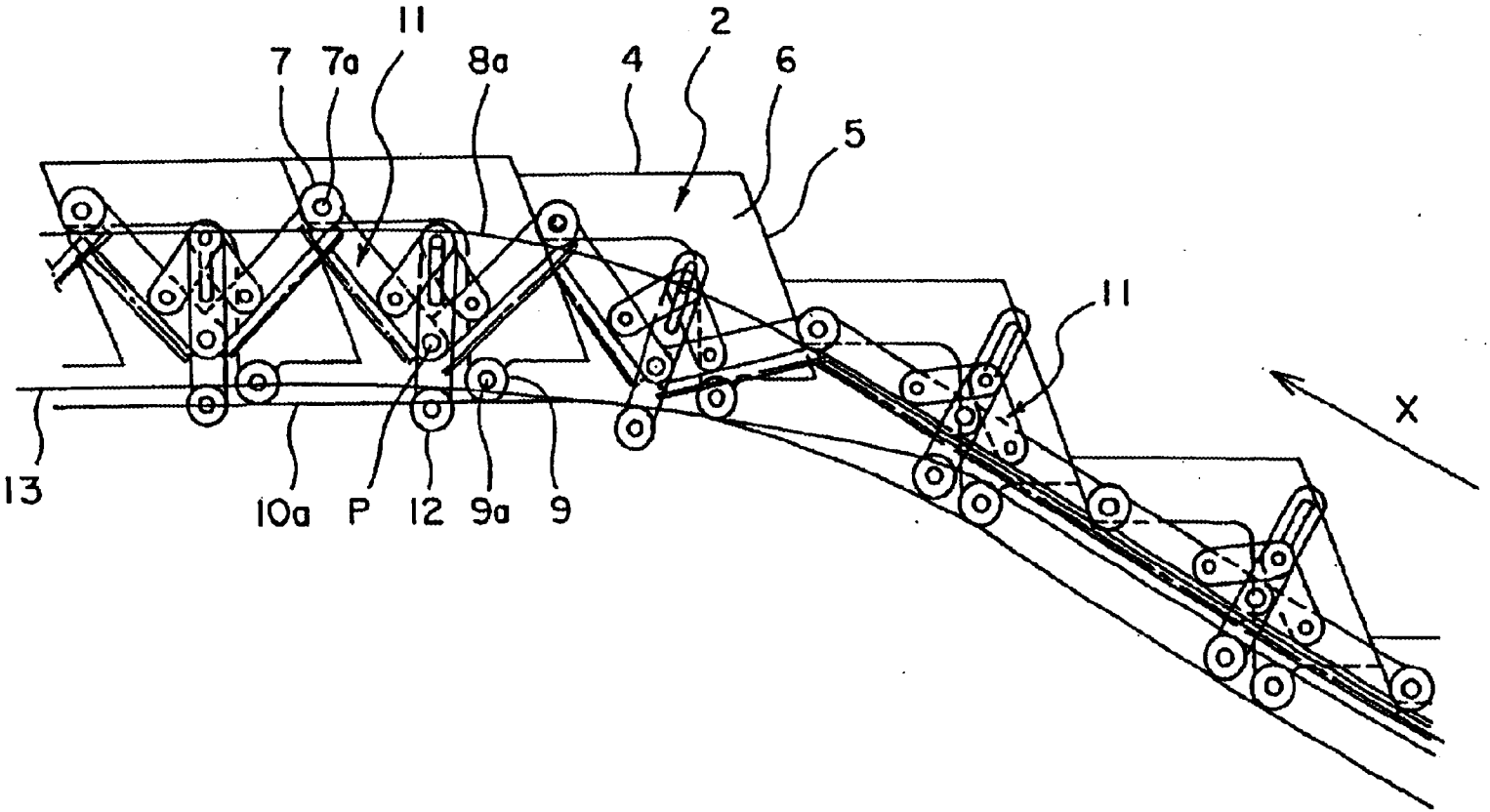
PRIOR ART FIG. 7
FIG. 7 is a side view showing the vicinity of a forward path side upper curved section of FIG. 6 in an enlarged state.
Figure 8:
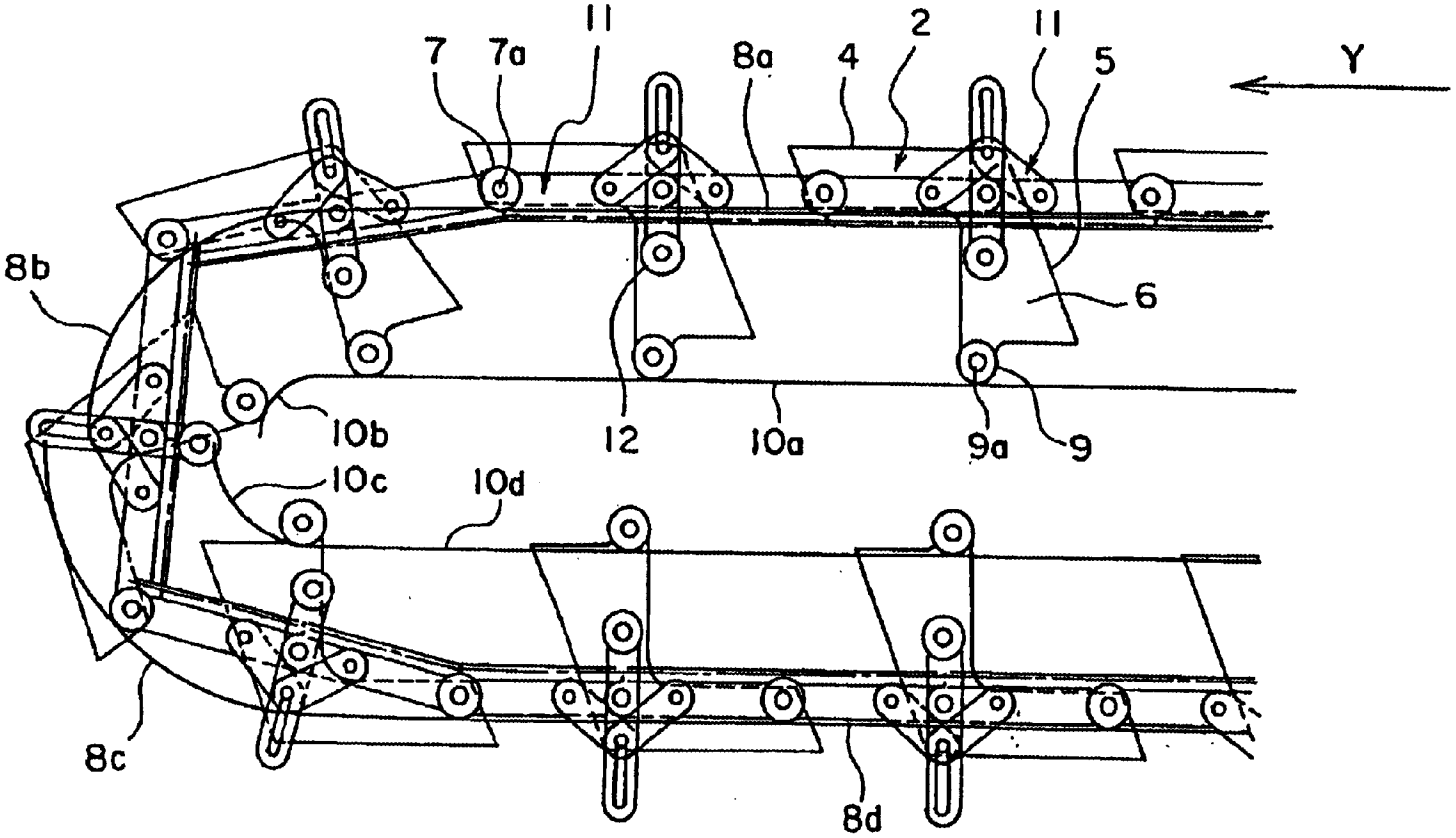
PRIOR ART FIG. 8
FIG. 8 is a side view showing the vicinity of an upper side reversing section of FIG. 6 in an enlarged state.
Figure 9:
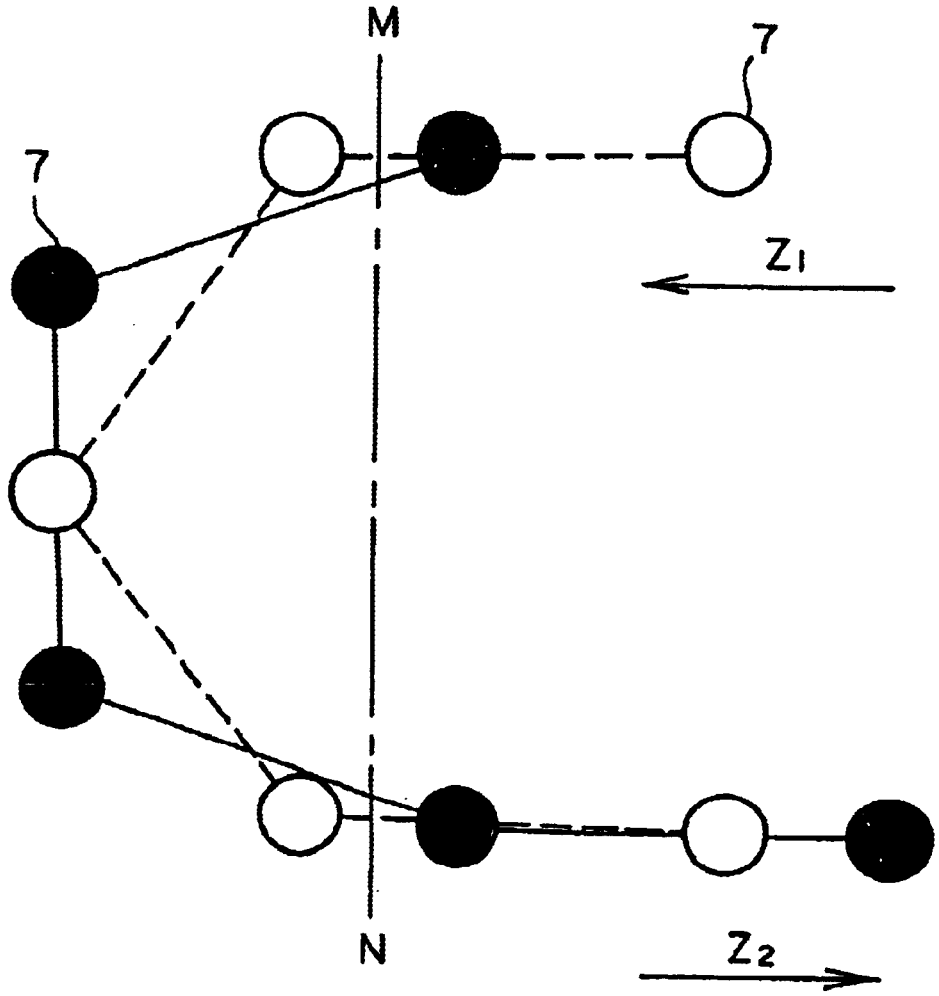
PRIOR ART FIG. 9
FIG. 9 is an explanatory view showing movements of driving rollers in the reversing section of FIG. 8.

The driving roller shafts 7*a* of the adjacent steps 2 are coupled with each other by the link mechanism (bending link mechanism) 15. Although the link mechanism 15 in the first embodiment is not limited to this, it has a simpler structure than the link mechanism 11 using a quadric link mechanism shown in the conventional example (FIGS. 7 and 8).

Figure 3:
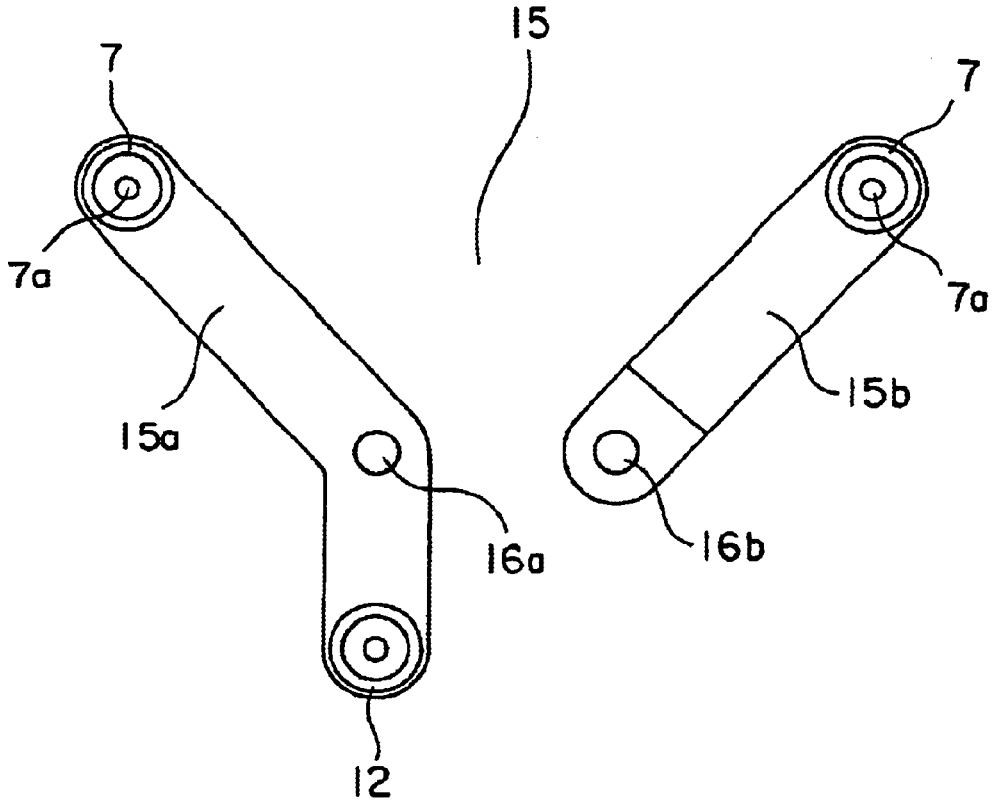
FIG. 3 is a structural diagram showing the link mechanism of FIG. 2 in a disassembled state.

FIG. 3 is a structural diagram showing the link mechanism 15 of FIG. 2 in a disassembled state. In the figure, the link mechanism 15 has a first link 15*a* which is bent in its middle portion and a second link 15*b* of a linear shape. The first link 15*a* and the second link 15*b* are pivotably coupled with each other via a coupling shaft (not shown) in coupling parts 16*a* and 16*b* thereof, respectively.

One end portion of the first link 15*a* is coupled to the driving roller shaft 7*a*. Rotatable auxiliary rollers 12 are provided at the other end portion of the first link 15*a*. A coupling part 16*a* is provided in a curved part of the first link 15*a*. One end portion of the second link 15*b* is coupled to the driving roller shaft 7*a* of the step 2 adjacent to it. A coupling part 16*b* is provided at the other end portion of the second link 15*b*.

Although the link mechanism 15 in the first embodiment has the same function as the link mechanism 11 of the conventional example, since it is not only simple in structure but also small in the number of bearing parts, a positioning error due to influence of loose fitting is reduced.

In FIG. 2, the auxiliary rollers 12 are guided by forward path side auxiliary rails 13*a*, reversing section auxiliary rails 13*b*, and return path side auxiliary rails 13*c* which are provided in the main frame 1. In particular, in the reversing section and the vicinity thereof, the auxiliary rails 13*a* to 13*c* are formed in a shape with which an opening angle of the link mechanism 15 is maintained at approximately 180°.

In the reversing section, there is provided an outer peripheral length change absorbing mechanism 17 for guiding the movement of the driving roller 7 while absorbing change in an outer peripheral length of a polygon formed by connecting the axes of the driving rollers 7 with straight lines (hereinafter referred to as a polygon with the driving roller axis as its vertex). The outer peripheral length change absorbing mechanism 17 has upper side swing rails 17*a*, lower side swing rails 17*b*, and a coupling plate 17*c*.

The upper side swing rails 17*a* and the lower side swing rails 17*b* are rails of substantially an arc shape, respectively. One end portion of the upper side swing rails 17*a* is axially supported by a shaft 18*a* so as to be swingable. In addition, one end portion of the lower side swing rails 17*b* is axially supported by a shaft 18*b* so as to be swingable. Note that the shafts 18*a* and 18*b* are provided on a fixed part side fixed to the main frame 1.

Moreover, a shaft 19*a* provided at the other end portion of the upper side swing rails 17*a* and a shaft 19*b* provided at the other end portion of the lower side swing rails 17*b* are coupled with each other via the coupling plate 17*c*. The coupling plate 17*c* is rotatably coupled to the upper side and lower side swing rails 17*a* and 17*b* with the shafts 19*a* and 19*b* as centers.

In the outer peripheral length change absorbing mechanism 17 constituted as described above, in the case in which the steps 2 move in the reversing section and the outer peripheral length of the polygon with the driving roller axis as its vertex becomes long, the upper and lower swing rails 17*a* and 17*b* displace so as to expand outwardly with the shafts 18*a* and 18*b* as centers, respectively, to guide the movement of the driving rollers 7. On the other hand, in the case in which the outer peripheral length of the polygon with the driving roller axis as its vertex becomes short, the upper and lower swing rails 17*a* and 17*b* displace so as to close inwardly to guide the movement of the driving rollers 7. Such an amount of displacement of the swing rails 17*a* and 17*b* is, for example, approximately 10 mm.

Accordingly, the change in the outer peripheral length of the polygon with the driving roller axis as its vertex in the reversing section is absorbed. Therefore, the increase in the drive resistance force of the steps 2 due to the increase in the pressing force of the driving rollers 7 to the rails can be suppressed, and the smooth reversing movement of the steps 2 can be realized. In addition, a step track never loses its shape significantly.

Moreover, in the first embodiment, in the reversing section and the vicinity thereof, the forward path side auxiliary rails 13*a*, the reversing section auxiliary rails 13*b*, and the return path side auxiliary rails 13*c*, for guiding the auxiliary rollers 12, are formed in a shape for maintaining the opening angle of the link mechanism 15 at approximately 180°. Therefore, the link mechanism 15 is straightened between the driving roller shafts 7*a* of the adjacent steps 2 and a reversing radius of the steps 2 is controlled to be small, whereby miniaturization of the apparatus can be realized. In addition, since the gap of the steps 2 widens, the steps 2 can be prevented from interfering with each other during reversing.

Second Embodiment

Figure 4:
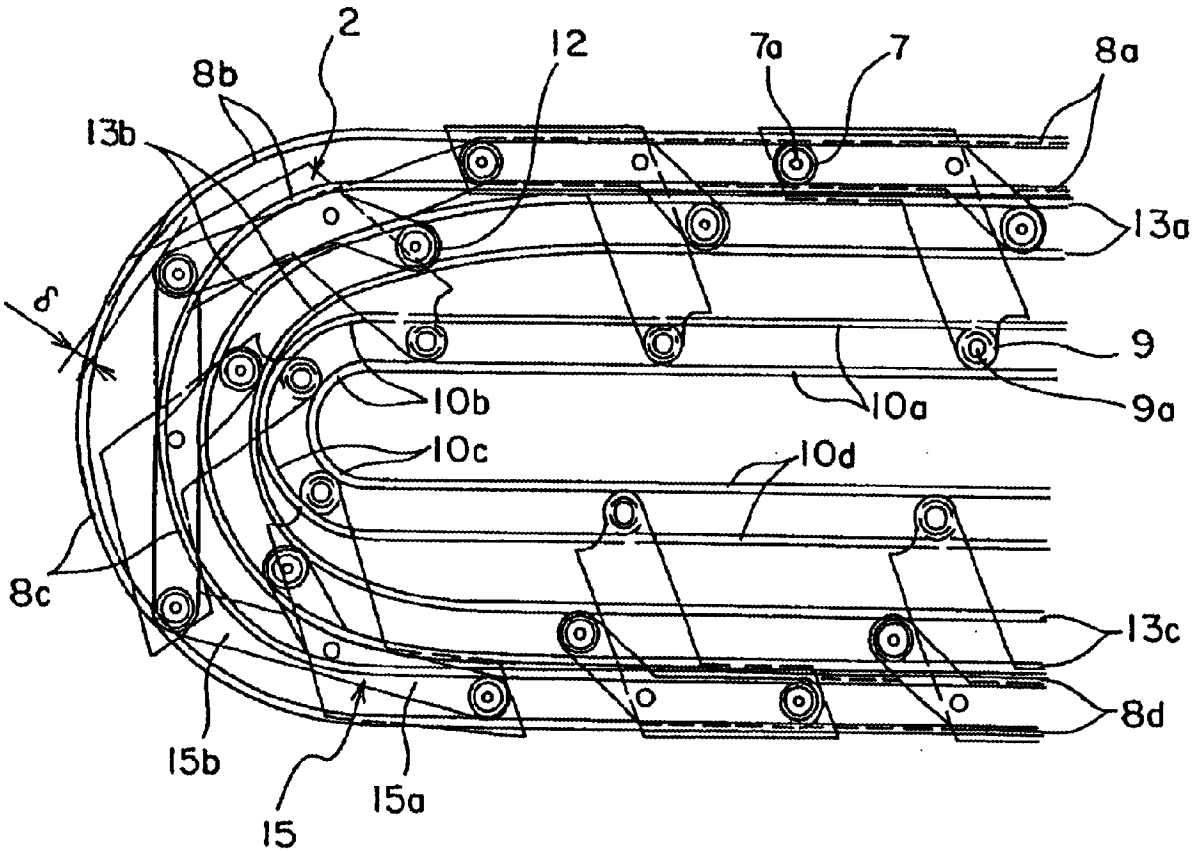
FIG. 4 is a side view showing an upper side reversing section of an escalator with a high speed inclined section according to a second embodiment of the present invention.

Next, FIG. 4 is a side view showing an upper side reversing section of an escalator with a high speed inclined section according to a second embodiment of the present invention. In the figure, forward path side auxiliary rails 13*a*, reversing section auxiliary rails 13*b*, and return path side auxiliary rails 13*c* are formed in a shape for guiding auxiliary rollers 12 such that an opening angle of a link mechanism 15 is approximately 180° in a reversing section and the vicinity thereof.

Forward path side reversing section drive rails 8*b* and return path side reversing section drive rails 8*c* have a structure in which rolling surfaces of driving rollers 7 are nipped from both sides thereof. In addition, the forward path side reversing section drive rails 8*b* and the return path side reversing section drive rails 8*c* are arranged such that loose fitting occurs between the driving rollers 7 and the rails intentionally.

That is, an allowance is provided between a rail interval of the forward path side reversing section drive rails 8*b* and the return path side reversing section drive rails 8*c* and a diameter of the driving rollers 7. A size . of a gap generated by this allowance is set to a size of such a degree that allows the gap to absorb a change in an outer peripheral length of a polygon with a driving roller axis as its vertex (e.g., approximately 10 mm). The outer peripheral length change absorbing mechanism in the second embodiment has the forward path side reversing section drive rails 8*b* and the return path side reversing section drive rails 8*c*.

According to such an outer peripheral length change absorbing mechanism, when passing the reversing section, the driving rollers 7 become capable of moving also in a direction perpendicular to an advancing direction thereof with a degree of freedom to some extent. Therefore, in the case in which the outer peripheral length of the polygon with the driving roller axis as its vertex becomes long due to the movement of steps 2, the driving rollers 7 track a moving route expanded outwardly. Conversely, in the case in which the outer peripheral length of the polygon with the driving roller axis as its vertex becomes short, the driving rollers 7 track a moving route reduced inwardly.

In this way, the change in the outer peripheral length of the polygon with the driving roller axis as its vertex is absorbed by the gap . of the rail intervals in the forward path side reversing section drive rails 8*b* and the return path side reversing section drive rails 8*c*. Accordingly, the increase in the drive resistance force of the steps 2 due to the increase in the pressing force of the driving rollers 7 to the rails can be suppressed, and the smooth reversing movement of the steps 2 can be realized. In addition, a step track never loses its shape significantly.

Moreover, in the second embodiment, as in the first embodiment, since the opening angle of the link mechanism 15 is maintained at approximately 180° in the reversing section and the vicinity thereof, the link mechanism 15 is straightened between the driving roller shafts 7*a* of the adjacent steps 2 and a reversing radius of the steps 2 is controlled to be small, whereby miniaturization of the apparatus can be realized. In addition, since the gap of the steps 2 widens, the steps 2 can be prevented from interfering with each other during reversing.

Third Embodiment

Figure 5:
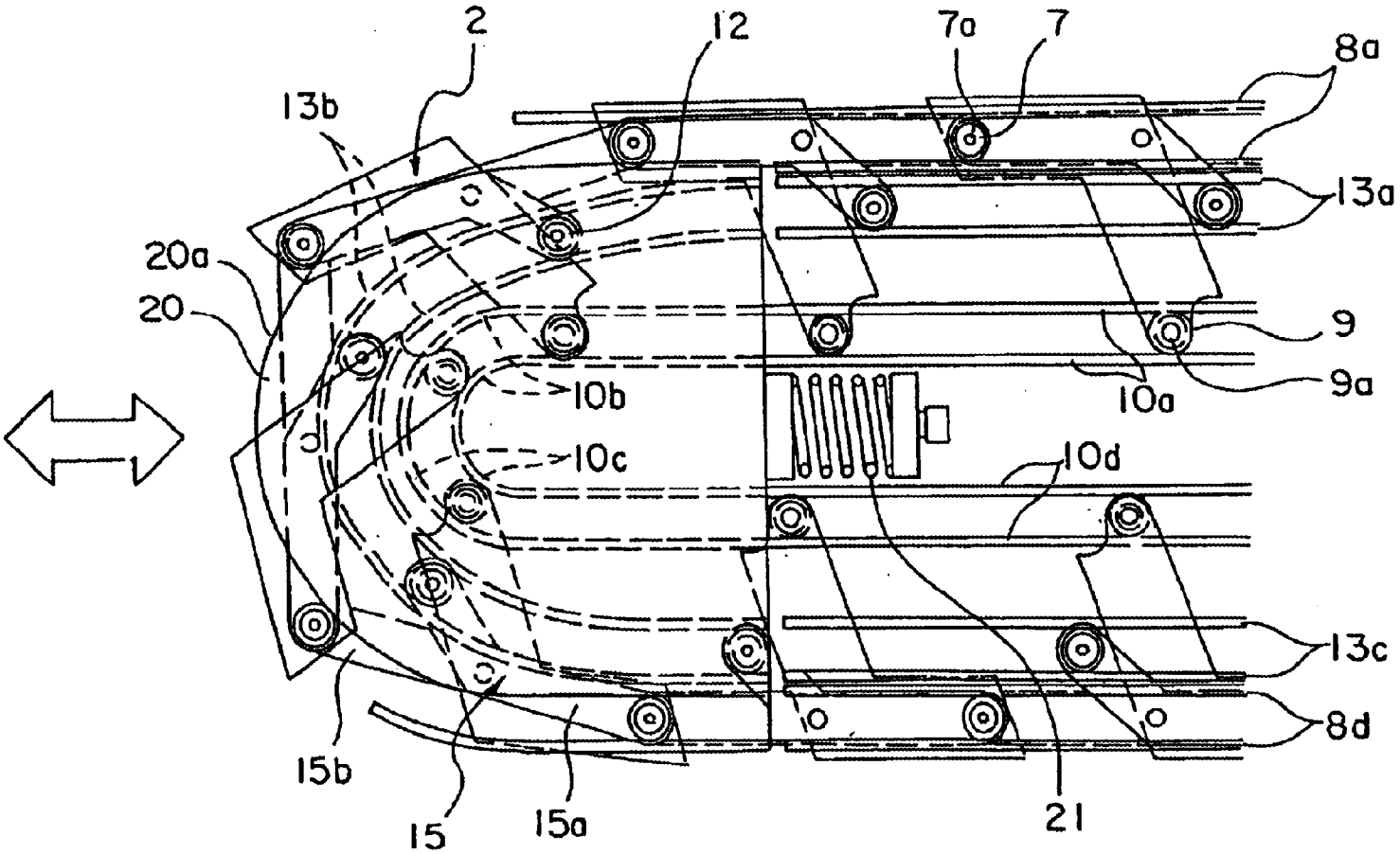
FIG. 5 is a side view showing an upper side reversing section of an escalator with a high speed inclined section according to a third embodiment of the present invention.
Figure 6:
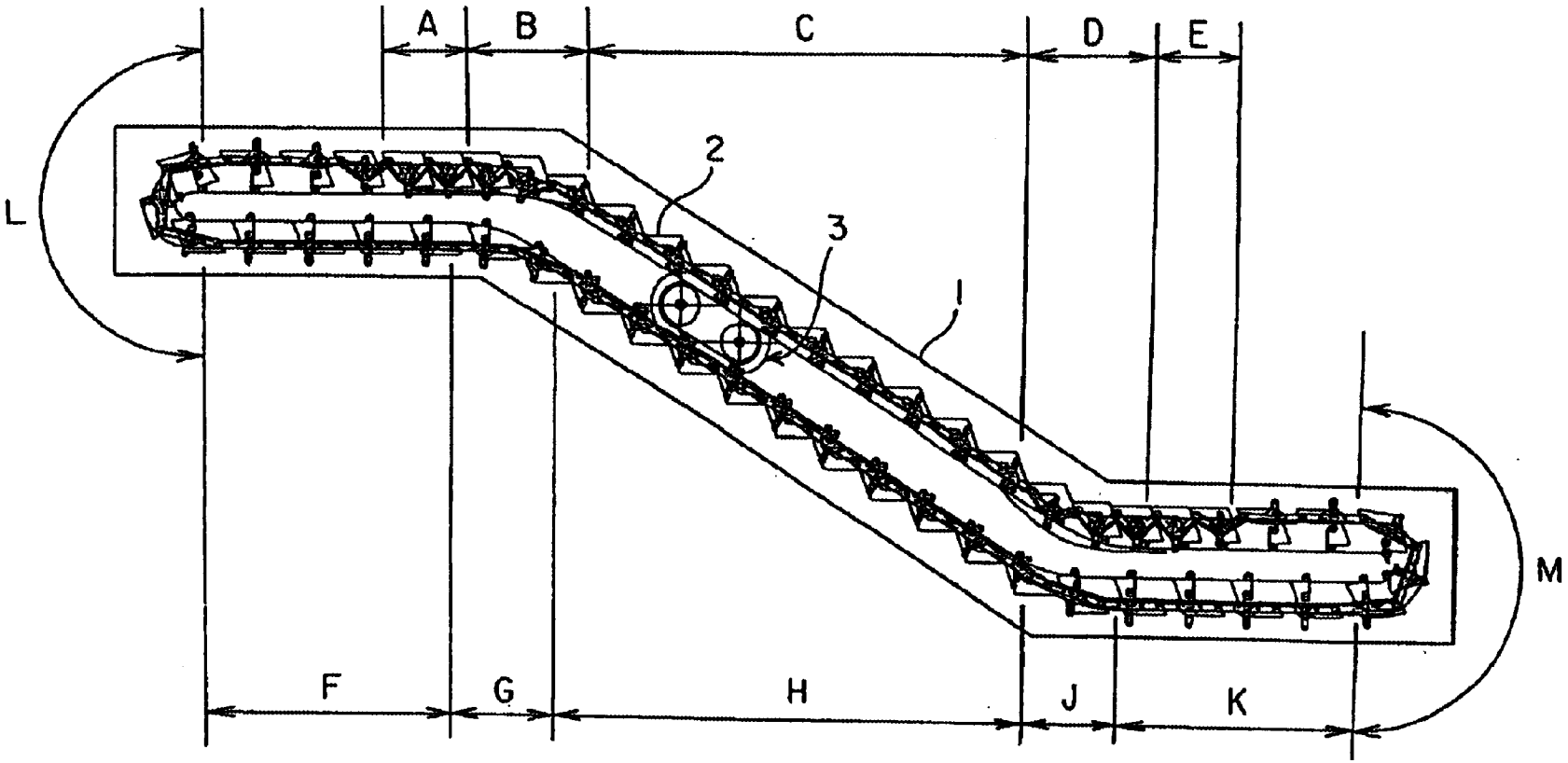
PRIOR ART FIG. 6
FIG. 6 is a schematic side view showing an example of a conventional escalator with a high speed inclined section.

FIG. 5 is a side view showing an upper side reversing section of an escalator with a high speed inclined section according to a third embodiment of the present invention. In the figure, forward path side auxiliary rails 13*a*, reversing section auxiliary rails 13*b*, and the return path side auxiliary rails 13*d* are formed in such a shape as to guide auxiliary rollers 12 such that an opening angle of a link mechanism 15 is approximately 180° in a reversing section and the vicinity thereof.

A moving stand 20 which is reciprocatingly movable in a horizontal direction (arrow direction in the figure) is provided in the reversing section. The moving stand 20 is biased to an outside direction of a circulation path of steps 2 by a spring 21. A guide part 20*a* of an arc shape for guiding driving rollers 7 is formed in an outer peripheral part of the moving stand 20. That is, the guide part 20*a* of the moving stand 20 plays a role of reversing section drive rails. In addition, the driving rollers 7 are pressed outwardly by the moving stand 20.

Moreover, the reversing section auxiliary rails 13*b* are attached to the moving stand 20, and the reversing section auxiliary rails 13*b* move integrally with the moving stand 20. Therefore, the guide part 20*a* and the reversing section auxiliary rails 13*b* are elastically supported by the spring 21 integrally via the moving stand 20. The movable guide part in the third embodiment has the moving stand 20 and the reversing section auxiliary rails 13*b*. In addition, the outer peripheral length change absorbing mechanism has the movable guide part and the spring 21.

With this structure, in the case in which the outer peripheral length of the polygon with the driving roller axis as its vertex becomes long due to the movement of the steps 2, the moving stand 20 moves outwardly to guide the movement of the driving rollers 7. Conversely, in the case in which the outer peripheral length of the polygon with the driving roller axis as its vertex becomes short, the moving stand 20 moves inwardly against the spring 21 to guide the movement of the driving roller 7. An amount of displacement of this moving stand 20 is, for example, approximately 10 mm.

In this way, the change in the outer peripheral length of the polygon with the driving roller axis as its vertex is absorbed by the displacement of the moving stand 20. Therefore, the increase in the drive resistance force of the steps 2 due to the increase in the pressing force of the driving rollers 7 to the rails can be suppressed, and the smooth reversing movement of the steps 2 can be realized. In addition, a step track never loses its shape significantly.

Moreover, in the third embodiment, as in the first embodiment, since the opening angle of the link mechanism 15 is maintained at approximately 180° in the reversing section and the vicinity thereof, the link mechanism 15 is straightened between the driving roller shafts 7*a* of the adjacent steps 2 and a reversing radius of the steps 2 is controlled to be small, whereby miniaturization of the apparatus can be realized. In addition, since the gap of the steps 2 widens, the steps 2 can be prevented from interfering with each other during reversing.

Note that, although the spring 21 is provided inside the circulation path of the steps 2 to press the moving stand 20 outwardly, a spring may be provided outside the circulation path of the steps 2 to pull the moving stand 20 outwardly.

In addition, although the link mechanism having a simple structure as shown in FIG. 3 is described as the link mechanism for coupling the driving roller shafts 7*a* of the adjacent steps 2 in the first to third embodiments, for example, a link mechanism using the same quadric link as in the conventional example may be used.

Moreover, although the upper side reversing section is described in the first to third embodiments, it goes without saying that the same structure can be adopted in a lower side reversing section.

What is claimed is:

1. An escalator with a high speed inclined section comprising:

a main frame;

a plurality of steps located in the main frame and coupled in an endless manner to move and circulate;

a driving roller shaft and a trailing roller shaft on each of the steps;

driving rollers on each of the steps and rotatable about the driving roller shaft;

trailing rollers on each of the steps and rotatable about the trailing roller shaft;

a plurality of link mechanisms which couple the driving roller shafts of adjacent steps and which transform for changing an interval between the driving roller shafts;

rotatable auxiliary rollers on each of the link mechanisms;

drive rails on the main frame for guiding movement of the driving rollers;

trail rails on the main frame for guiding movement of the trailing rollers;

auxiliary rails on the main frame for guiding movement of the auxiliary rollers for transforming the link mechanisms; and an outer peripheral length change absorbing mechanism, in a reversing section of a circulation path of the steps, for absorbing a change in an outer peripheral length of a polygon, formed by connecting axes of the driving rollers with straight lines, while guiding the movement of the driving rollers in the reversing section.

2. The escalator with a high speed inclined section according to claim 1, wherein the outer peripheral length change absorbing mechanism guides the movement of the driving rollers and includes swing rails which swing according to the change in the outer peripheral length.

3. The escalator with a high speed inclined section according to claim 2, wherein the swing rails have upper side swing rails and lower side swing rails, and the upper side and lower side swing rails are coupled with each other by a coupling plate rotatably coupled to the upper side and lower side swing rails.

4. The escalator with a high speed inclined section according to claim 1, wherein the outer peripheral length change absorbing mechanism includes reversing section drive rails nipping rolling surfaces of the driving rollers from both sides, and a rail interval of the reversing section drive rails is set with an allowance with respect to a diameter of the driving rollers, whereby the change in the outer peripheral length is absorbed by the allowance.

5. The escalator with a high speed inclined section according to claim 1, wherein the outer peripheral length change absorbing mechanism includes a movable guide part for guiding the driving rollers and the auxiliary rollers, the guiding part being reciprocatingly movable in a horizontal direction, and a spring for biasing the movable guide part toward an outward direction of the circulation path of the steps.

6. The escalator with a high speed inclined section according to claim 5, wherein the movable guide part includes a moving stand having an outer periphery, a guide part having an arc shape for guiding the driving rollers on the outer periphery of the moving stand, and reversing section auxiliary rails attached to the moving stand and moving integrally with the moving stand for guiding the auxiliary rollers.

7. The escalator with a high speed inclined section according to claim 1, wherein the auxiliary rails in the reversing section are shaped so that an opening angle of the link mechanisms is maintained at approximately 180°.

* * * * *